US011788733B2

(12) United States Patent
Jang et al.

(10) Patent No.: US 11,788,733 B2
(45) Date of Patent: Oct. 17, 2023

(54) COOKING APPLIANCE

(71) Applicant: Samsung Electronics Co., Ltd., Suwon-si (KR)

(72) Inventors: Hyeong Jin Jang, Suwon-si (KR); Han Jun Sung, Suwon-si (KR); Yu Jeub Ha, Suwon-si (KR); Nok Ho Bae, Suwon-si (KR); Duck Jin Sung, Suwon-si (KR); Min Ho Yun, Suwon-si (KR); Yong Seok Jang, Suwon-si (KR); Ji Ho Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/210,969

(22) Filed: Mar. 24, 2021

(65) Prior Publication Data

US 2021/0207813 A1 Jul. 8, 2021

Related U.S. Application Data

(63) Continuation of application No. 15/699,618, filed on Sep. 8, 2017, now Pat. No. 10,962,234.

(30) Foreign Application Priority Data

Sep. 9, 2016 (KR) ..... 10-2016-0116321

(51) Int. Cl.
*F24C 15/30* (2006.01)
*F24C 15/00* (2006.01)
(Continued)

(52) U.S. Cl.
CPC ..... *F24C 15/30* (2013.01); *F24C 7/067* (2013.01); *F24C 15/006* (2013.01); *F24C 15/02* (2013.01);
(Continued)

(58) Field of Classification Search
CPC ..... F24C 7/067; F24C 15/006; F24C 15/02; F24C 15/08; F24C 15/2007; F24C 15/30; F24C 15/322; F24C 7/06
(Continued)

(56) References Cited

U.S. PATENT DOCUMENTS 8,803,045 B2 * 8/2014 Cadima ..... H01F 38/14 99/324
9,170,026 B2 * 10/2015 Taplan ..... F24C 15/166
(Continued)

FOREIGN PATENT DOCUMENTS

DE 10 2004 003 116 8/2005
JP 2006-329456 12/2006
(Continued)

OTHER PUBLICATIONS

International Search Report dated Dec. 26, 2017, in corresponding International Patent Application No. PCT/KR2017/009886, 3 pgs.
(Continued)

*Primary Examiner* — Steven B McAllister
*Assistant Examiner* — Benjamin W Johnson
(74) *Attorney, Agent, or Firm* — STAAS & HALSEY LLP

(57) ABSTRACT

A cooking appliance includes a cavity and a partition configured to partition the cavity. The partition includes an upper partition, a lower partition, and a heater arranged between the upper partition and the lower partition. The partition further includes a heater installation member provided to detachably mount the heater. At least one of the upper partition and the lower partition further includes a heater installation member installation hole to install the heater.

12 Claims, 18 Drawing Sheets

(51) Int. Cl.

| | |
|---|---|
| ***F24C 7/06*** | (2006.01) |
| ***F24C 15/20*** | (2006.01) |
| ***F24C 15/08*** | (2006.01) |
| ***F24C 15/02*** | (2006.01) |
| ***F24C 15/32*** | (2006.01) |

(52) U.S. Cl.
CPC ..... *F24C 15/08* (2013.01); *F24C 15/2007* (2013.01); *F24C 15/322* (2013.01); *F24C 7/06* (2013.01)

(58) Field of Classification Search
USPC ..... 126/1 D
See application file for complete search history.

(56) References Cited

U.S. PATENT DOCUMENTS

| | | | | |
|---|---|---|---|---|
| 9,476,597 | B1 * | 10/2016 | Howerton | F24C 14/02 |
| 2006/0278214 | A1 | 12/2006 | Park | |
| 2007/0257020 | A1 * | 11/2007 | Nam | F24C 15/166 219/391 |
| 2009/0050130 | A1 | 2/2009 | Kim et al. | |
| 2013/0260320 | A1 | 10/2013 | Townsend | |
| 2015/0047623 | A1 | 2/2015 | Wiggins et al. | |

FOREIGN PATENT DOCUMENTS

| | | |
|---|---|---|
| JP | 2007-163127 | 6/2007 |
| KR | 20-1998-0045307 | 9/1998 |
| KR | 20-0365636 | 10/2004 |
| KR | 10-2006-0128383 | 12/2006 |
| KR | 10-2008-0070410 | 7/2008 |
| KR | 10-2009-0021036 | 2/2009 |
| KR | 10-2011-0078910 | 7/2011 |
| KR | 10-2011-0089530 | 8/2011 |
| KR | 10-2012-0020769 | 3/2012 |
| KR | 10-2016-0075259 | 6/2016 |

OTHER PUBLICATIONS

Extended European Search Report dated May 20, 2019 in corresponding European Patent Application No. 17849137.9.
Chinese Office Action dated Mar. 27, 2020 in Chinese Patent Application No. 201780053704.7.
European Communication dated Apr. 29, 2020 in European Patent Application No. 17849137.9.
European Communication dated Nov. 17, 2020 in European Patent Application No. 17849137.9.
Chinese Office Action dated Nov. 6, 2020 in Chinese Patent Application No. 201780053704.7.
U.S. Office Action dated Apr. 10, 2019 in U.S. Appl. No. 15/699,618.
U.S. Office Action dated Oct. 21, 2019 in U.S. Appl. No. 15/699,618.
U.S. Office Action dated Jan. 10, 2020 in U.S. Appl. No. 15/699,618.
U.S. Office Action dated Jul. 10, 2020 in U.S. Appl. No. 15/699,618.
U.S. Notice of Allowance dated Nov. 17, 2020 in U.S. Appl. No. 15/699,618.
U.S. Advisory Action dated Sep. 9, 2020 in U.S. Appl. No. 15/699,618.
U.S. Appl. No. 15/699,618, filed Sep. 8, 2017, Hyeong Jin Jang, et al., Samsung Electronics Co., Ltd..
Korean Office Action dated Oct. 5, 2022 in Korean Patent Application No. 10-2016-0116321 (8 pages; 12 pages English translation).

* cited by examiner

COOKING APPLIANCE

CROSS-REFERENCE TO RELATED APPLICATION

This application is a continuation application of U.S. patent application Ser. No. 15/699,618 filed on Sep. 8, 2017, which claims the benefit of Korean Patent Application No. 10-2016-0116321, filed on Sep. 9, 2016 in the Korean Intellectual Property Office, the disclosures of which are incorporated herein by reference in their entirety.

BACKGROUND

1. Field

Embodiments of the present disclosure relate to a cooking appliance, and more particularly, to a cooking appliance having an improved heater installation structure.

2. Description of the Related Art

Cooking appliances are appliances configured to cook food. There are various types of cooking appliances, and an oven is one example.

Generally, an oven is an appliance for cooking food by including a cooking compartment, a heater configured to apply heat to the cooking compartment, and a circulator configured to circulate heat generated by the heater inside the cooking compartment.

An oven is an appliance for cooking an object to be cooked by sealing and heating the object to be cooked and may be classified as an electric type, a gas type, and an electronic type in accordance with a heat source thereof. An electric oven uses an electric heater as a heat source, and a gas oven and a microwave respectively use heat generated by gas and frictional heat of water molecules generated by high frequency as heat sources.

Nowadays, built-in type cooking appliances are increased in consideration of various utilizations of a kitchen space, to arranging the cooking appliances to fit the kitchen furniture, or to store the cooking appliances in preinstalled kitchen furniture for efficient utilization of a kitchen space.

A storage space is formed in a preinstalled piece of furniture, and a built-in type cooking appliance is configured to be stored in the storage space of the piece of furniture and be used by a user while being stored in the piece of furniture.

SUMMARY

Therefore, it is an aspect of the present disclosure to provide a cooking appliance having an improved heater installation structure.

It is another aspect of the present disclosure to provide a cooking appliance capable of facilitating replacement and after-sales service of a heater due to an improved heater installation structure.

It is still another aspect of the present disclosure to provide a cooking appliance capable of reducing a service cost by enabling a heater to be replaced.

It is yet another aspect of the present disclosure to provide a cooking appliance capable of improving efficiency of a heater by being able to separate a cooling flow path and the heater from each other due to an improved heater installation structure.

Additional aspects of the disclosure will be set forth in part in the description which follows and, in part, will be obvious from the description, or may be learned by practice of the disclosure.

In accordance with one aspect of the present disclosure, a cooking appliance includes a cavity, a heater disposed below the cavity, and a heater installation member to mount the heater, the heater installation member including a first heater installation member provided below the cavity so that the heater is attachable to or detachable from the first heater installation member, and a second heater installation member attachable to or detachable from a rear portion of the first heater installation member.

The second heater installation member may be inclined at a rear end of the first heater installation member.

The second heater installation member may includes a heater installation hole formed to be at least partially perforated.

The first heater installation member may include a bottom surface provided below the cavity, side surfaces formed to be bent upward from both sides of the bottom surface, and a rear surface extending to be inclined upward from a rear end of the bottom surface and having a second heater installation member installation hole formed by at least a portion thereof cut away.

A slope of the rear surface may be substantially identical to a slope of the second heater installation member.

The cooking appliance may further include a case provided outside the cavity and one or more fans provided between the cavity and the case, wherein a cooling flow path formed by the one or more fans may be provided between the cavity and the case.

The second heater installation member may be provided to isolate the cooling flow path from the heater.

The cooking appliance may further include a heater cover formed of an insulating material and provided so that the heater is coupled between the cavity and the first heater installation member.

The heater cover may include a heater guide formed so that the heater is seated thereon, and the heater guide may be formed to be open in a direction in which the heater is withdrawn.

The case may include one or more partitions configured to partition the cooling flow path.

The second heater installation member may further include a sealing member provided at the heater installation hole.

The cavity may include a first cavity forming a first cooking compartment, and a second cavity stacked on the first cavity and forming a second cooking compartment.

A first fan configured to form a flow of air that flows inside the first cooking compartment and a second fan configured to form a flow of air that flows outside the first cooking compartment, and a third fan configured to form a flow of air that flows inside and outside the second cooking compartment, the first fan and the second fan being installed at the first cavity and the third fan being installed at the second cavity.

The case may further include a flow path guide provided on the cooling flow path.

The cooking appliance may further include a partition configured to partition the cavity, and the partition may include the heater installation member.

In accordance with another aspect of the present disclosure, a cooking appliance includes a case, a cavity provided inside the case, a cooling flow path provided between the case and the cavity, a heater disposed below the cavity, and a heater installation member provided to attachable to or detachable from the heater, wherein the heater installation member includes a first heater installation member provided below the cavity so that the heater is installed therein and a second heater installation member attachable to or detachable from a rear portion of the first heater installation member and provided to isolate the cooling flow path from the heater.

The second heater installation member may be inclined at a rear end of the first heater installation member.

The second heater installation member may include a heater installation hole formed to be at least partially perforated to guide movement during an insertion or withdrawal of the heater from the heater installation member.

The case may further include a flow path guide provided on the cooling flow path.

The cavity may include a built-in type cavity.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
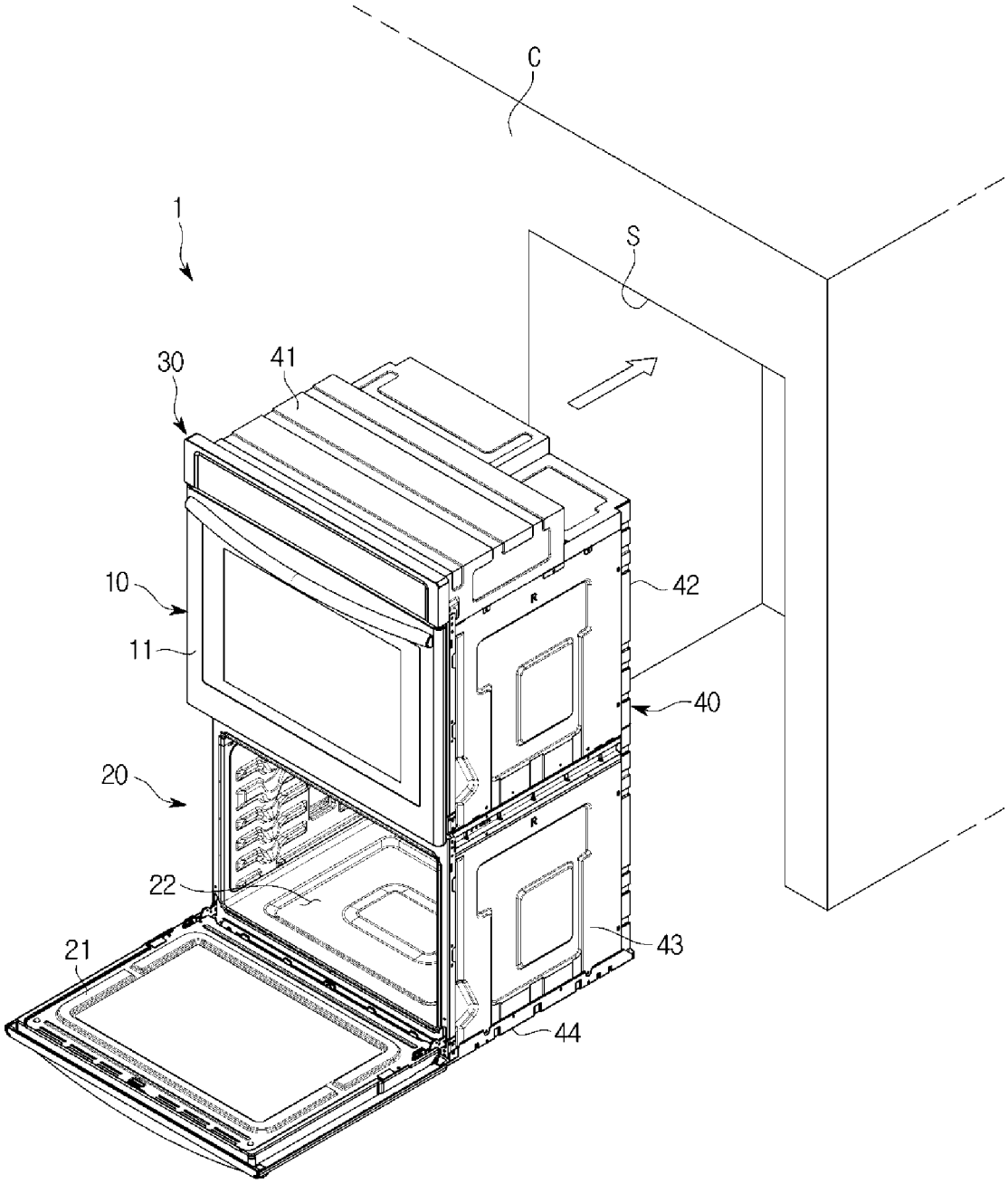
FIG. 1 is a perspective view illustrating a cooking appliance according to an embodiment of the present disclosure.

Various embodiments described herein and configurations illustrated in the drawings are merely exemplary embodiments of the present disclosure, and various modifications which may replace the embodiments and the drawings herein may be present at the time of filing this application.

Like reference numerals or symbols presented in the drawings of the application indicate parts or elements that perform substantially the same functions.

Terms used herein are for describing the embodiments and are not intended to limit and/or restrict the disclosure. A singular expression includes a plural expression unless context clearly indicates otherwise. In the application, terms such as "include" or "have" should be understood as designating that features, number, steps, operations, elements, parts, or combinations thereof exist and not as precluding the existence of or the possibility of adding one or more other features, numbers, steps, operations, elements, parts, or combinations thereof in advance.

Terms including ordinals such as "first" and "second" may be used to describe various elements, but the elements are not limited by the terms. The terms are only used for the purpose of distinguishing one element from another element. For example, a second element may be referred to as a first element while not departing from the scope of the present disclosure, and likewise, a first element may also be referred to as a second element. The term "and/or" includes a combination of a plurality of related described items or any one item among the plurality of related described items.

Hereinafter, embodiments according to the present disclosure will be described in detail with reference to the accompanying drawings.

"Front surface" and "front" used hereinafter respectively refer to a front surface visible from in front of a cooking appliance 1 illustrated in FIG. 1 and a direction toward the front of the cooking appliance 1, and "rear" refers to a direction toward the rear of the cooking appliance 1. Although the cooking appliance according to an embodiment of the present disclosure is described as a built-in that is installed in a cabinet, the present disclosure is applicable to a cooking appliance using a heater.

Figure 2:
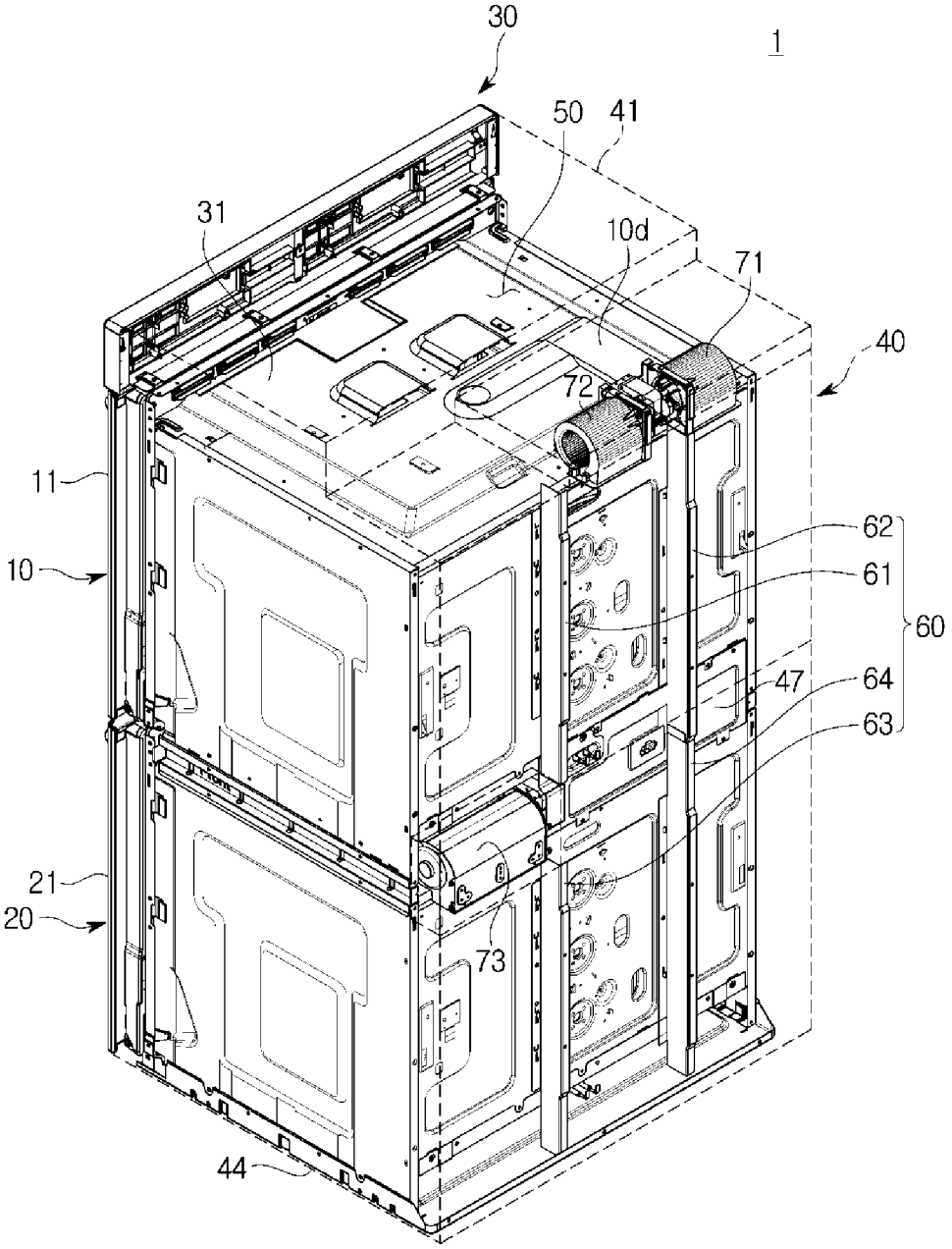
FIG. 2 is a rear perspective view illustrating the cooking appliance according to the embodiment of the present disclosure with a part thereof cut away.
Figure 3:
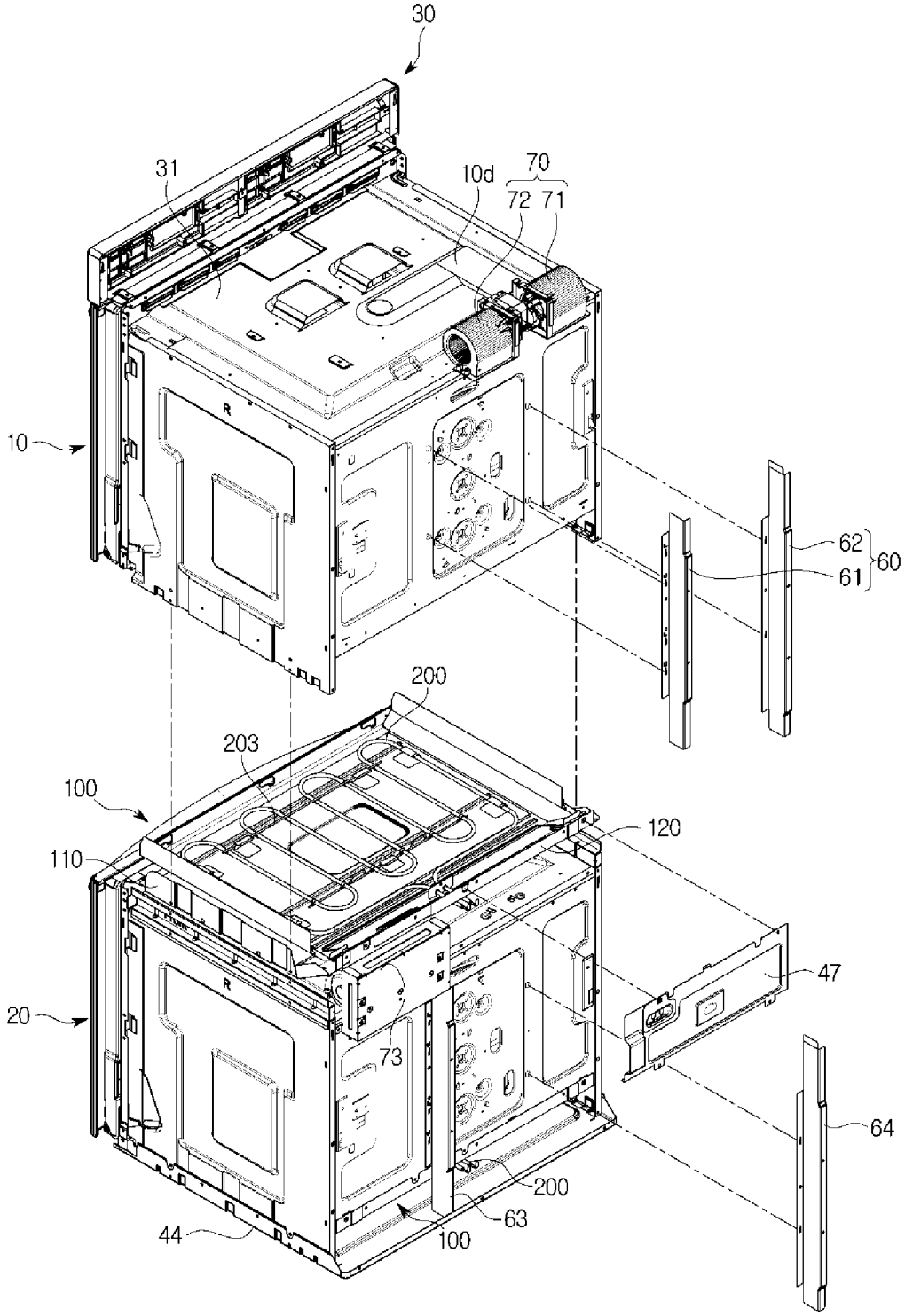
FIG. 3 is an exploded perspective view of a part of the cooking appliance according the embodiment of the present disclosure.

FIG. 1 is a perspective view illustrating a cooking appliance according to an embodiment of the present disclosure, FIG. 2 is a rear perspective view illustrating the cooking appliance according to the embodiment of the present disclosure with a part thereof cut away, and FIG. 3 is an exploded perspective view of a part of the cooking appliance according the embodiment of the present disclosure.

As illustrated in FIGS. 1 to 3, a cooking appliance 1 may be installed in a piece of furniture, a wall, or a cabinet C to have a sense of unity with a kitchen space. The cabinet C for installing the cooking appliance 1 has, for example, an open front surface, and the cooking appliance 1 may be accommodated in an accommodating portion S inside the cabinet C via the open portion.

The cooking appliance 1 may include a first cavity 10 and a second cavity 20 provided for cooking food, and a control panel 30 having various electric components installed therein.

The first cavity 10 includes a first cooking compartment 12, and the second cavity 20 includes a second cooking compartment 22. A convection device (not illustrated) may be installed in each of the first cavity 10 and the second cavity 20. The convection device is provided to heat and circulate air inside the cooking compartments for cooking food inside the cooking compartments separately from a heater 200. Preferably, one or more convection devices are installed at a rear surface of each of the cavities 10 and 20.

The first cavity 10 and the second cavity 20 may be vertically stacked and disposed. Although an example in which the first cavity 10 is disposed above the second cavity 20 is illustrated in the embodiment of the present disclosure, arrangement of the first cavity 10 and the second cavity 20 is not limited thereto.

The control panel 30 may be disposed above the first cavity 10 to receive operational signals for operations of the first cavity 10 and the second cavity 20. The control panel 30 may be provided to display information related to operations of the first cavity 10 and the second cavity 20. A machine room 31 for a plurality of electronic components to be provided therein may be provided behind the control panel 30.

Although not illustrated, a magnetron configured to supply high frequency waves to insides of the cavities 10 and 20, and a high-pressure transistor, a high-pressure condenser, a high-pressure diode, and the like constituting a driving circuit for driving the magnetron may be installed inside the machine room 31 of the cavities 10 and 20 in which the control panel 30 is installed. One or more fans 70, which will be described below, may be provided behind the machine room 31. The fans 70 may be provided to suction outside air and cool various electronic components inside the machine room 31.

The first cavity 10 and the second cavity 20 may be formed in a rectangular parallelepiped shape with an open front surface. Doors 11 and 21 configured to selectively open or close the open front surfaces of the first cavity 10 and the second cavity 20 may be provided. The doors 11 and 21 may include a first door 11 provided to open or close the first cavity 10 and a second door 21 provided to open or close the second cavity 20.

A case 40 forming an exterior may be provided at outsides of the first cavity 10 and the second cavity 20. The case 40 may include an upper plate 41 configured to cover an upper side of the first cavity 10, side plates 43 configured to cover both sides of the cavities 10 and 20, a bottom plate 44 configured to cover a lower side of the second cavity 20, and a rear plate 42 configured to cover rear surfaces of the cavities 10 and 20.

The machine room 31 may be provided inside the upper plate 41. The upper plate 41 and the rear plate 42 may be provided to be spaced a predetermined distance apart from the cavities 10 and 20. Cooling flow paths 50 may be formed at gaps between the cavities 10 and 20 and the case 40.

The one or more fans 70 may be provided in the cooling flow paths 50 to suction outside air and allow air to flow. One or more partitions 60 may be provided in the cooling flow paths 50. The partitions 60 may be provided at outer rear portions of the first cavity 10 and the second cavity 20. The partitions 60 may be vertically disposed between the first cavity 10, the second cavity 20, and the rear plate 42.

The cooling flow paths 50 may include a first cooling flow path 51*a* configured to form a flow of air that flows inside the cavities 10 and 20, and a second cooling flow path 52*a* configured to form a flow of air that flows outside the cavities 10 and 20.

A first partition 61 and a second partition 62 may be disposed at a rear surface of the first cavity 10, and a third partition 63 and a fourth partition 64 may be disposed at a rear surface of the second cavity 20. The partitions 60 are provided to partition the cooling flow paths 50. Here, the first partition 61 and the third partition 63 may be coaxially disposed, and the second partition 62 and the fourth partition 64 may be coaxially disposed.

A first fan 71 and a second fan 72 are provided at an upper rear portion of the first cavity 10. The first fan 71 is configured to form a flow of air that flows inside the first cooking compartment 12 of the first cavity 10. The second fan 72 is configured to form a flow of air that flows outside the first cooking compartment 12.

The first fan 71 may be disposed on the first cooling flow path 51*a*, and the second pan 72 may be disposed on the second cooling flow path 52*a*.

The first cooling flow path 51*a* may be formed by the first fan 71 and formed between the second partition 62, the fourth partition 64, and the side plates 43. The second cooling flow path 52*a* may be formed by the second fan 72 and formed between the first partition 61 and the second partition 62 and between the third partition 63 and the fourth partition 64. The first cooling flow path 51*a* is provided so that air inside the first cavity 10 may be suctioned by the first fan 71 and discharged. The second cooling flow path 52*a* is provided so that air outside the first cavity 10, i.e., air passed through the machine room 31, may be suctioned by the second fan 72 and discharged.

A first cavity hole 10*c* formed to be perforated so that air after cooking may be discharged from an inside of the first cooking compartment 12 by the first fan 71 may be formed at a upper surface of the first cavity 10. A first cooling flow path duct 10*d* forming the first cooling flow path 51*a* may be provided around the first cavity hole 10*c* so that air after cooking that is discharged via the first cavity hole 10*c* may be suctioned by the first fan 71 and flow.

Heater installation member 100 for installing the heater 200 may be provided below the first cavity 10.

Figure 4:
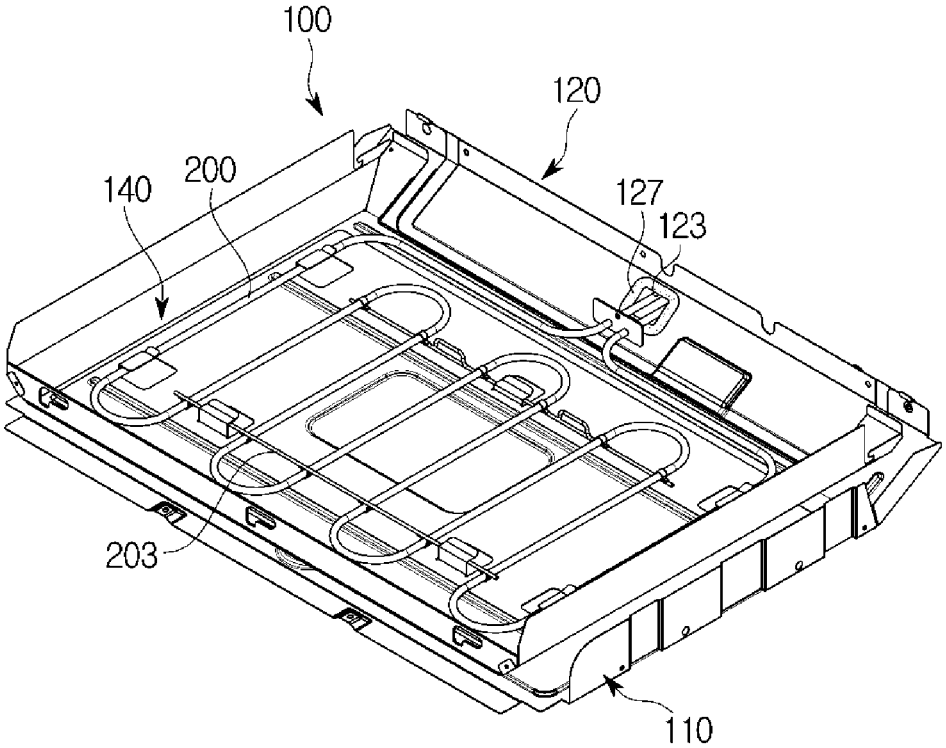
FIG. 4 is a perspective view illustrating heater installation member of the cooking appliance according to the embodiment of the present disclosure.
Figure 5:
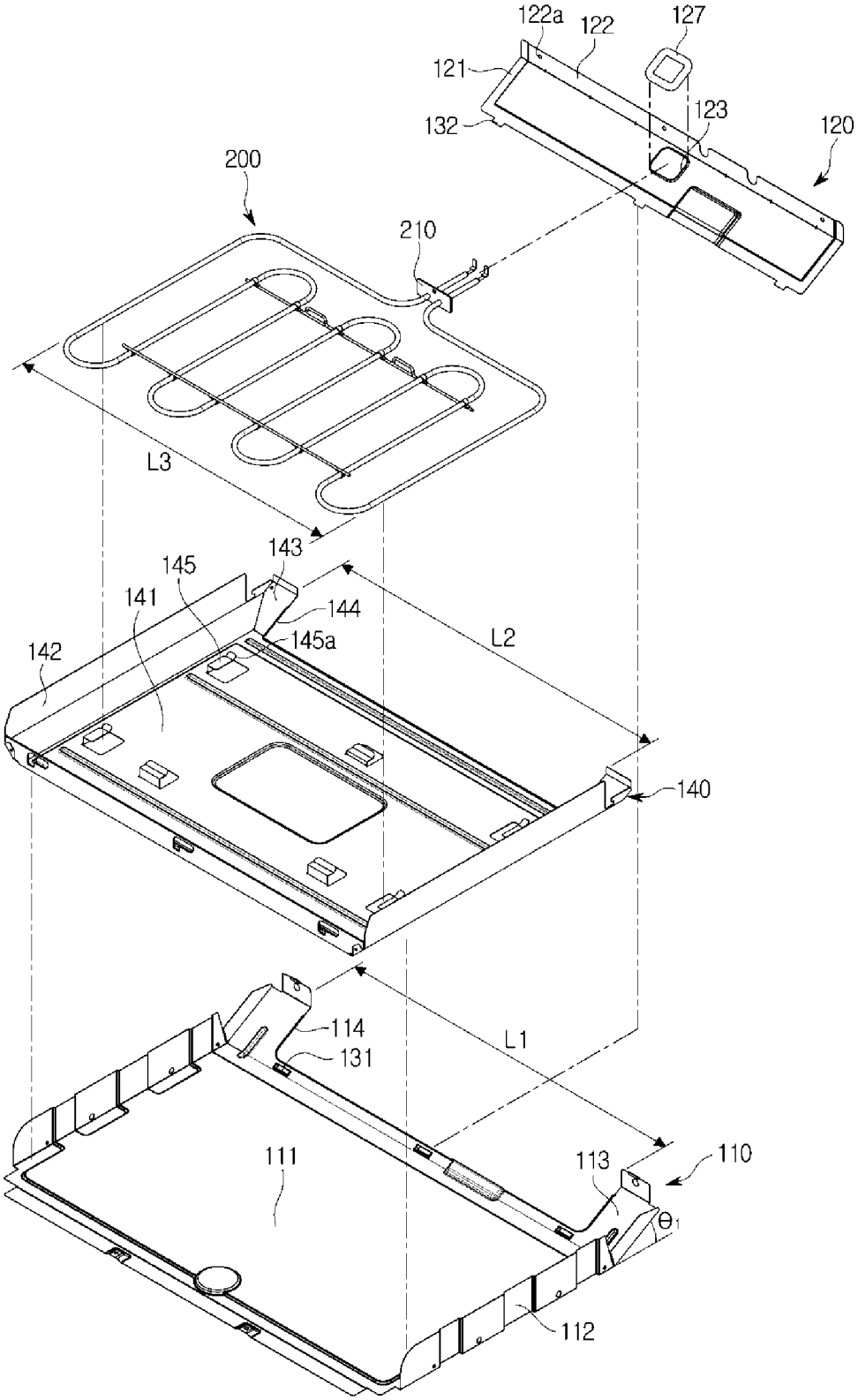
FIG. 5 is an exploded perspective view illustrating the heater installation member of the cooking appliance according to the embodiment of the present disclosure.
Figure 6:
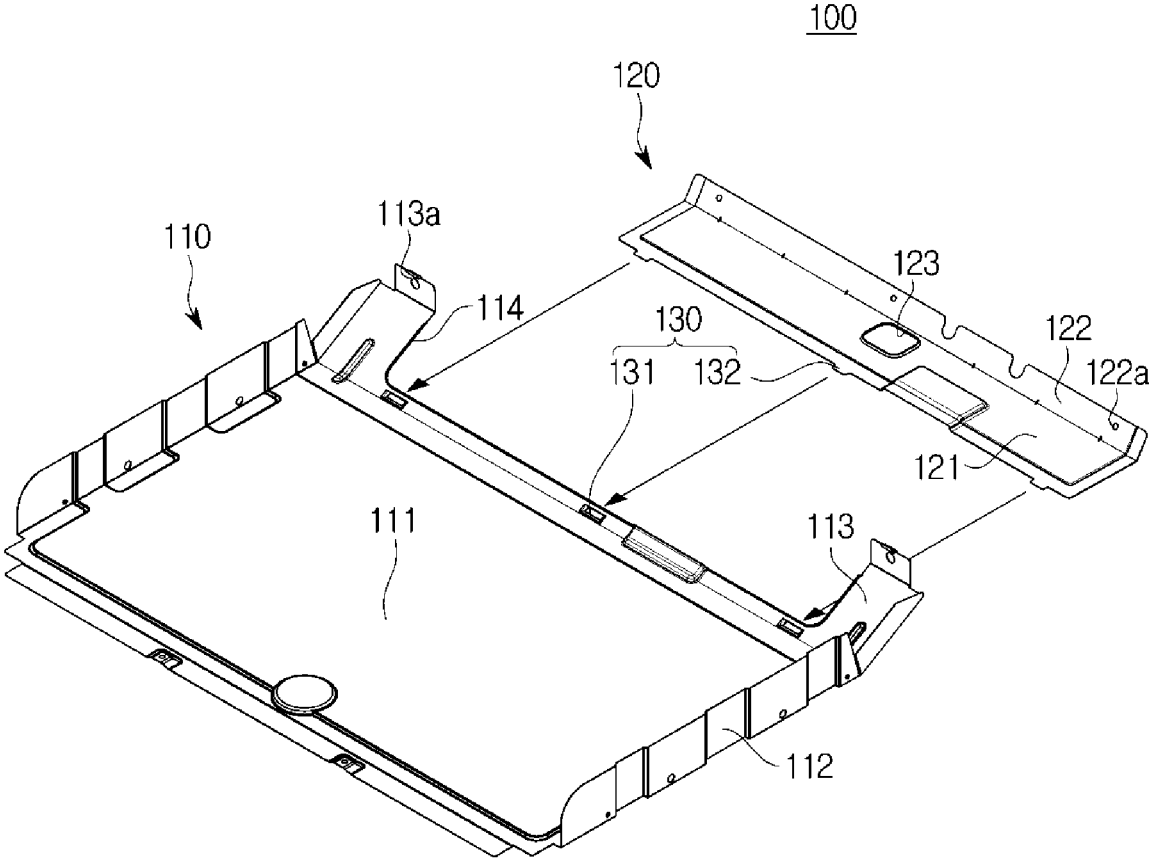
FIGS. 6 and 7 are views illustrating coupling between a first heater installation member and a second heater installation member of the heater installation member according to the embodiment of the present disclosure.
Figure 7:
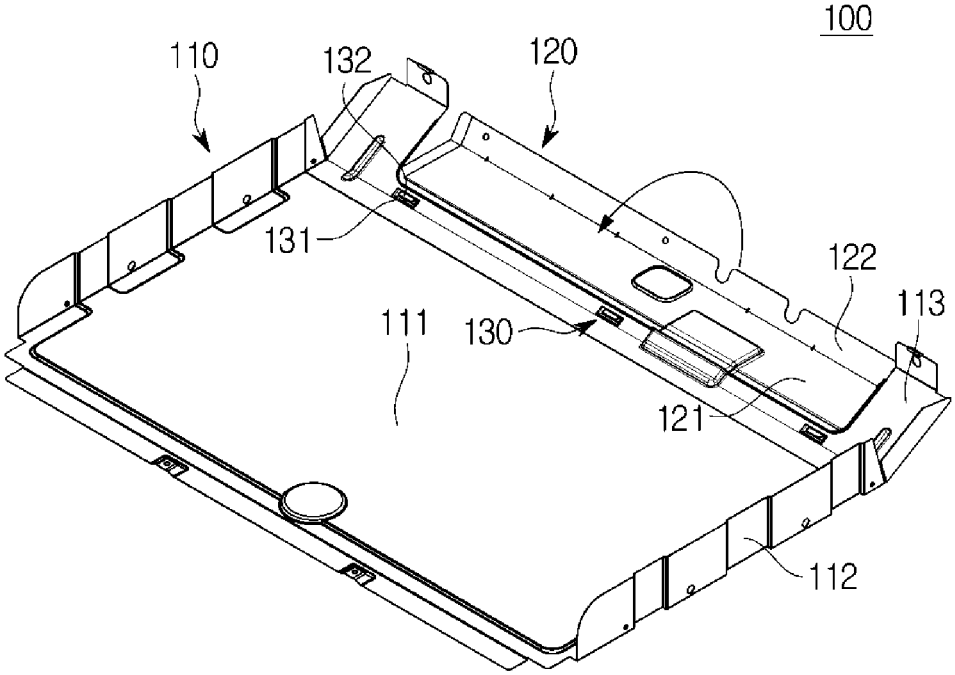

FIG. 4 is a perspective view illustrating heater installation member of the cooking appliance according to the embodiment of the present disclosure, FIG. 5 is an exploded perspective view illustrating the heater installation member of the cooking appliance according to the embodiment of the present disclosure, and FIGS. 6 and 7 are views illustrating coupling between a first heater installation member and a second heater installation member of the heater installation member according to the embodiment of the present disclosure As illustrated in FIGS. 4 to 7, the heater installation member 100 may be provided below the first cavity 10, and the heater 200 may be attachable to or detachable from the heater installation member 100. In the embodiment of the present disclosure, the heater installation member 100 may be provided below the first cavity 10 and below the second cavity 20.

The heater 200 may be supported by a heater bracket 210. The heater 200 may be formed to have a third length L3 as a transverse length.

The heater installation member 100 include a first heater installation member 110 and a second heater installation member 120 attachable to or detachable from a rear portion of the first heater installation member 110. The heater installation member 100 may further include a heater cover 140 configured to support the heater 200 by the heater 200 being coupled thereto. The heater cover 140 may be formed with an insulating material.

The first heater installation member 110 may be disposed below the first cavity 10. The first heater installation member 110 may include a bottom surface 111, side surfaces 112 formed to be bent upward from both sides of the bottom surface 111, and a rear surface 113 extending to be inclined upward from a rear end of the bottom surface 111.

The rear surface 113 of the first heater installation member 110 may be formed at a first angle θ1 from the bottom surface 111. The rear surface 113 of the first heater installation member 110 may include a second heater installation member installation hole 114 formed by at least a portion thereof cut away. The second heater installation member installation hole 114 may be formed to have a size and shape corresponding to those of the second heater installation member 120.

The first heater installation member 110 may further include a first coupler 131 for the second heater installation member 120 to be coupled thereto. One or more first couplers 131 may be formed at a lower portion of the rear surface 113. The first couplers 131 may be slits or holes formed by at least a portion thereof cut away. The first couplers 131 may be disposed below the second heater installation member installation hole 114. The second heater installation member installation hole 114 of the first heater installation member 110 may be formed to have a first length L1. Preferably, the first length L1 of the second heater installation member installation hole 114 is larger than the third length L3 of the heater 200.

The second heater installation member 120 may include an inclined surface 121 formed with a plate material having a slope, and a fixing surface 122 bent from an upper end of the inclined surface 121. The fixing surface 122 is provided to support and fix the second heater installation member 120 at a fixing portion (not illustrated) formed at the rear surfaces of the cavities 10 and 20. The fixing surface 122 may be formed to extend from the upper end of the inclined surface 121.

The inclined surface 121 of the second heater installation member 120 is formed at a second angle θ2 with respect to the first heater installation member 110. Here, the first angle θ1 of the rear surface 113 of the first heater installation member 110 and the second angle θ2 of the second heater installation member 120 may be formed to be identical to each other.

A heater installation hole 123 formed with at least a portion open may be provided at a central portion of the inclined surface 121 of the second heater installation member 120. The heater installation hole 123 may be formed so that the heater bracket 210 of the heater 200 may pass therethrough. A sealing member 127 may be provided at the heater installation hole 123 of the second heater installation member 120. The sealing member 127 may be disposed at a gap between the heater 200 and the heater installation hole 123 of the second heater installation member 120 and block the heater 200 from outside thereof.

A second coupler 132 for coupling the first heater installation member 110 and the second heater installation member 120 may be formed at a lower end of the inclined surface 121 of the second heater installation member 120. The second coupler 132 may be formed in a shape corresponding to that of the first coupler 131. One or more second couplers 132 may be formed at an end of the inclined surface 121. The second couplers 132 may include shapes of protrusions to correspond to the slits and holes of the first couplers 131.

The heater 200 may be installed and supported by the heater cover 140. The heater cover 140 may be formed with an insulating material. The heater cover 140 may be formed in a shape corresponding to that of the first heater installation member 110 to be seated on the first heater installation member 110. The heater cover 140 may include a heater guide 145 configured to support the heater 200. The heater guide 145 is formed so that the heater 200 may be supported by being seated on the heater cover 140. The heater guide 145 may include an opening 145*a* formed to be open in a moving direction of the heater 200 so that the heater 200 is movable in a transverse direction.

The heater 200 may further include a support 203 inserted into the heater guide 145 and provided to support the heater 200.

A heater cover installation hole 144 formed to be open for insertion and withdrawal of the heater 200 may be formed behind the heater cover 140. The heater cover installation hole 144 may be formed in a shape corresponding to the second heater installation member installation hole 114 of the first heater installation member 110. The heater cover installation hole 144 may have a second length L2. The second length L2 of the heater cover installation hole 144 may be formed to correspond to or be larger than the first length L1 of the second heater installation member installation hole 114 of the first heater installation member 110. The second length L2 of the heater cover installation hole 144 may be formed to correspond to or be larger than the third length L3 of the heater 200.

The heater cover 140 is seated at an upper side of the first heater installation member 110 to install the heater 200. The heater 200 is attachable to or detachable from the first heater installation member 110 by being movable in the transverse direction from the rear to the front of the first heater installation member 110.

The second heater installation member 120 may be attachable to or detachable from the first heater installation member 110 by the second couplers 132. The second couplers 132 of the second heater installation member 120 may be inserted into and temporarily assembled to the first couplers 131 formed at the rear surface 113 of the first heater installation member 110, and the second heater installation member 120 may be rotated to be coupled to the second heater installation member installation hole 114 of the first heater installation member 110. Although an example in which the first couplers and the second couplers are respectively holes and protrusions for coupling between the first heater installation member and the second heater installation member is illustrated in the embodiment of the present disclosure, the idea of the present disclosure is not limited thereto. For example, the first couplers and the second couplers may be connecting members such as hooks.

An undescribed reference symbol "122a" refers to a fixing hole formed at the fixing surface 122 of the second heater installation member 120 and is an element configured to fix the second heater installation member 120 to the cavities 10 and 20. The second heater installation member 120 may be fixed to the cavities 10 and 20 via a separate fixing member such as a screw. Although an example in which the second heater installation member 120 is fixed to the cavity by a fixing member (not illustrated) is described in the embodiment of the present disclosure, the idea of the present disclosure is not limited thereto. The second heater installation member may not be fixed to the cavity and may be attachable to or detachable from the first heater installation member.

Figure 8:
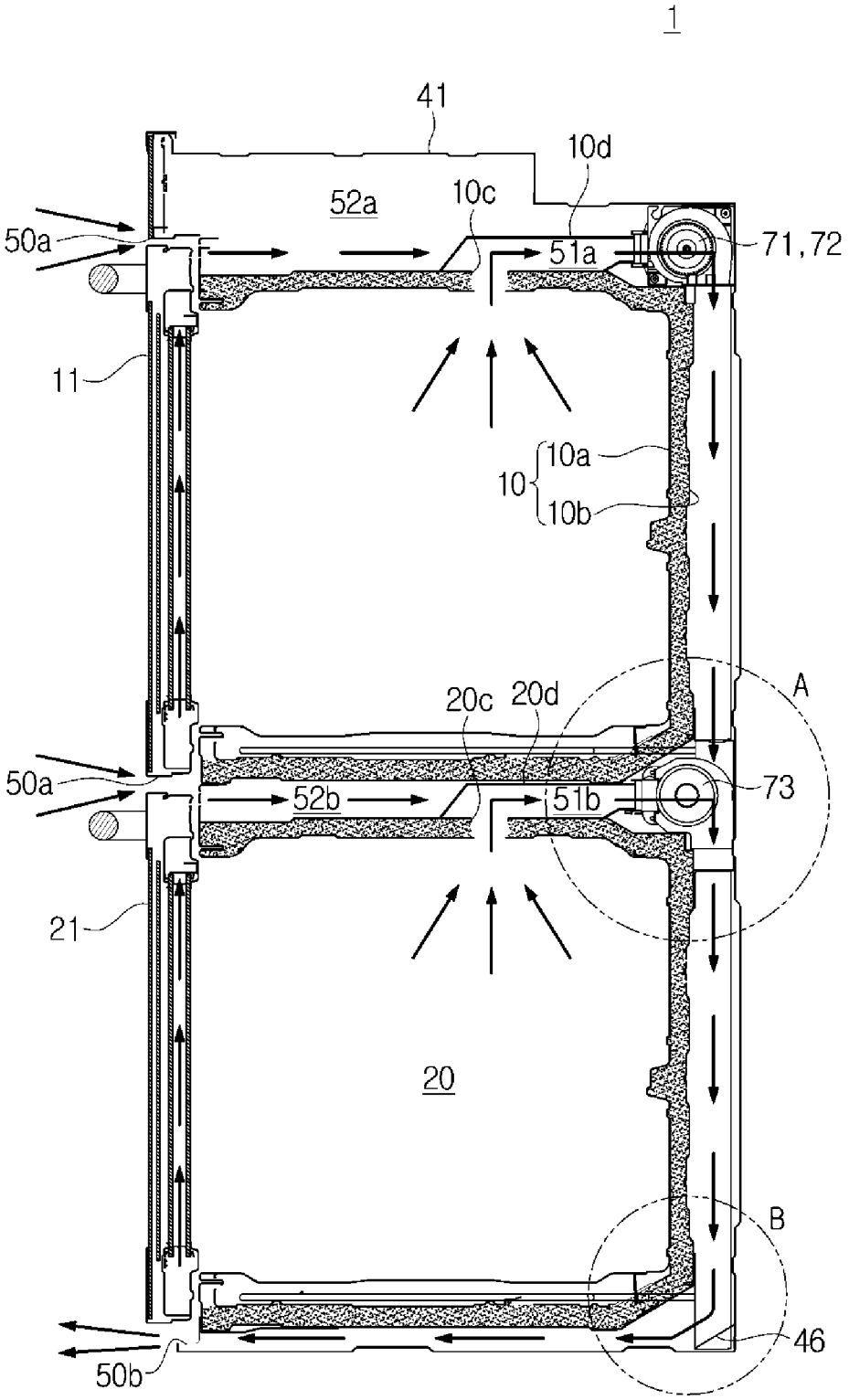
FIG. 8 is a longitudinal cross-sectional view illustrating a flow of air due to driving the cooking appliance according to the embodiment of the present disclosure.
Figure 9:
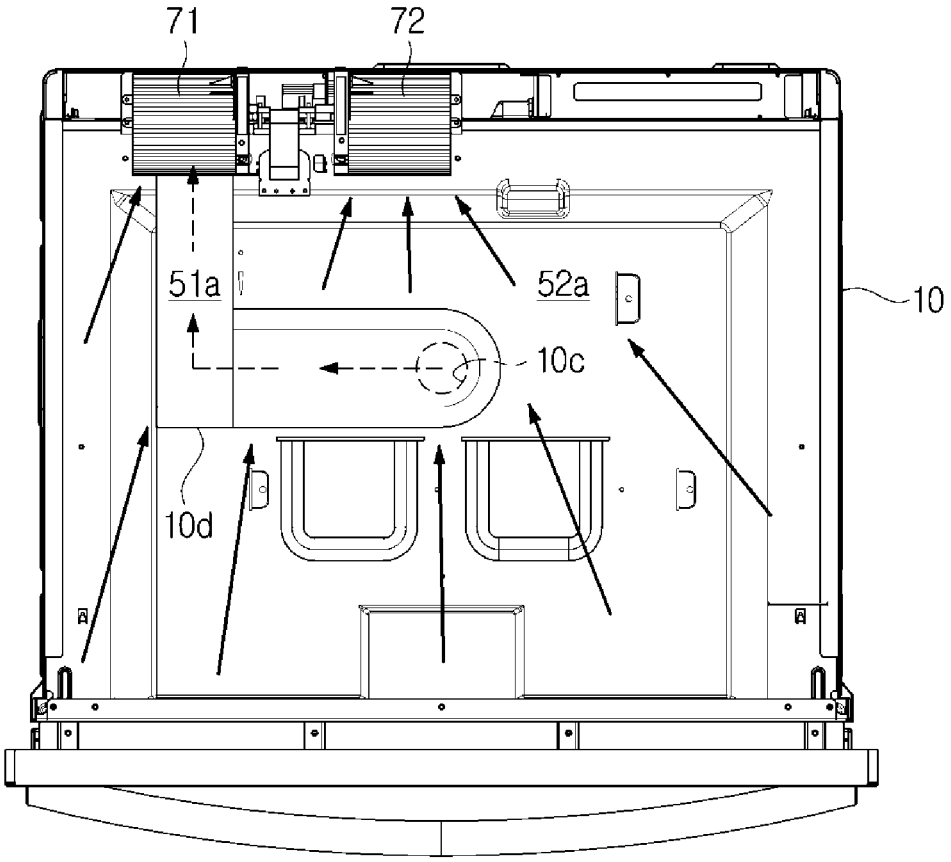
FIG. 9 is a view illustrating a flow of air due to driving a first fan and a second fan of a first cavity according to the embodiment of the present disclosure.
Figure 10:
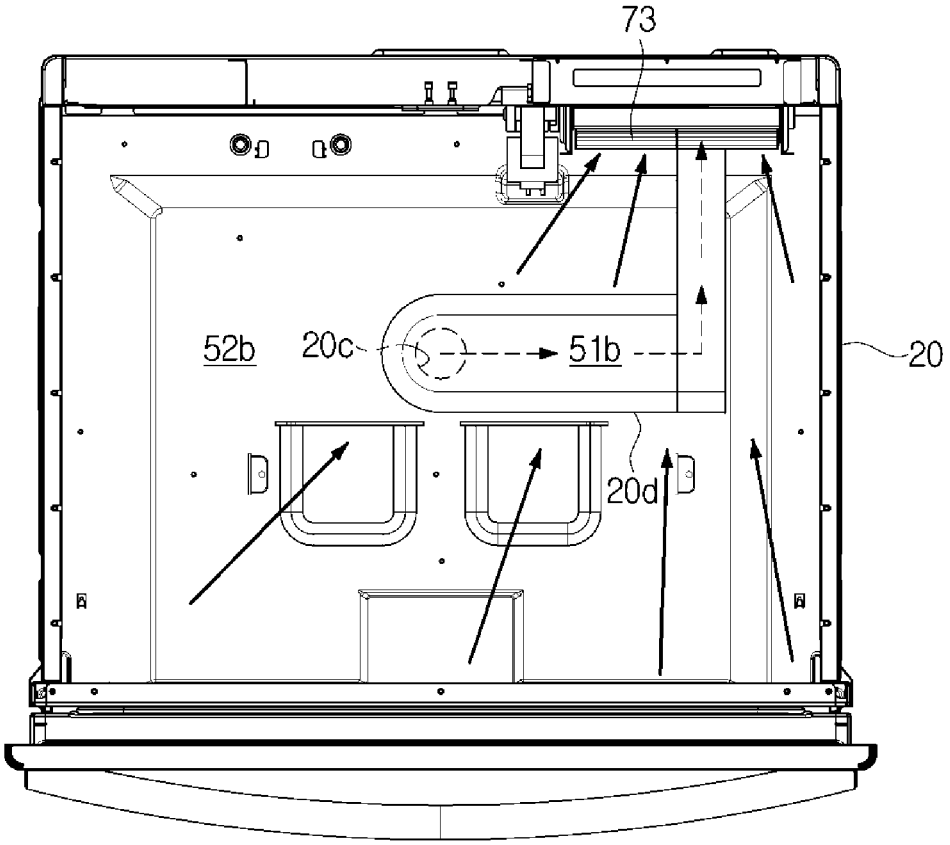
FIG. 10 is a view illustrating a flow of air due to driving a third fan of a second cavity according to the embodiment of the present disclosure.
Figure 11:
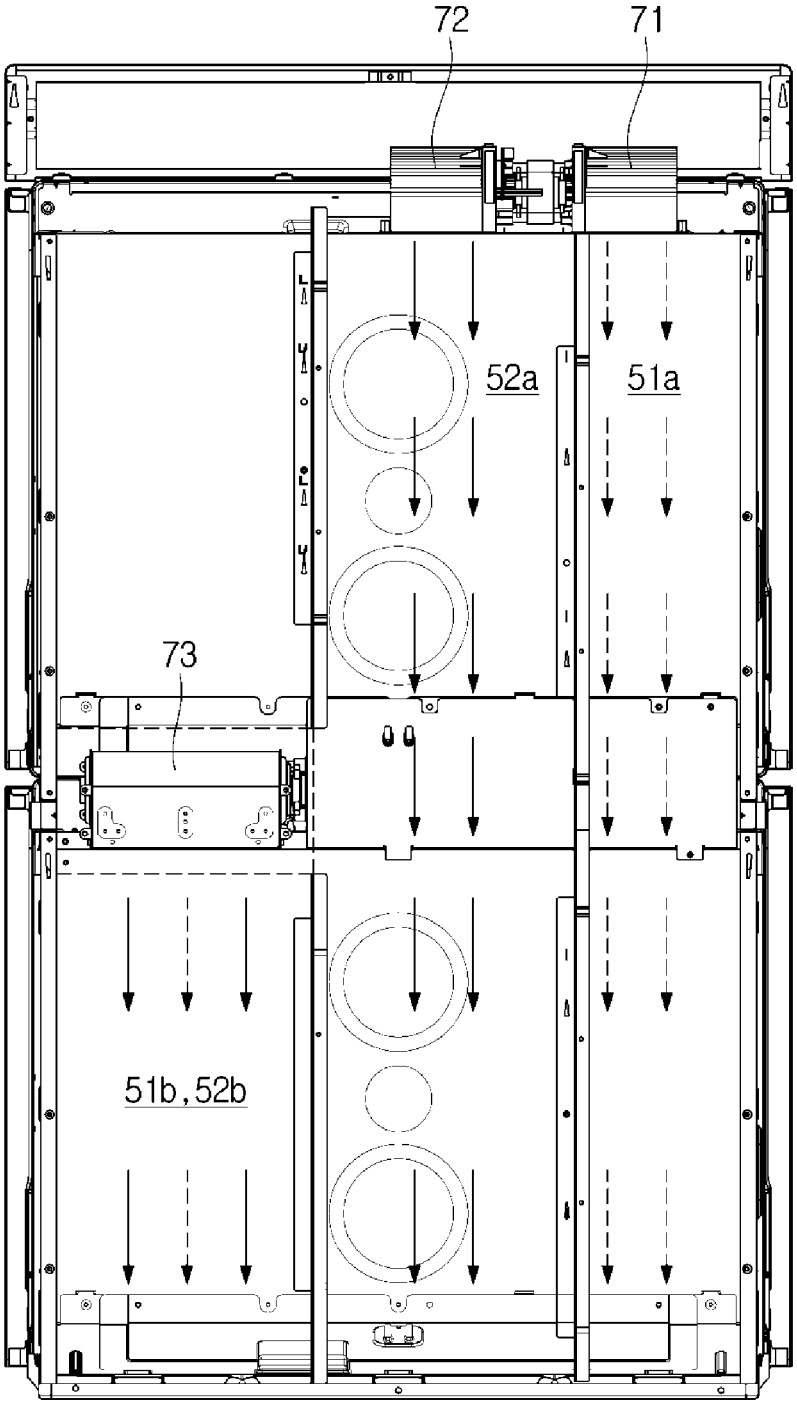
FIG. 11 is a view illustrating a flow of air due to driving the first cavity and the second cavity according to the embodiment of the present disclosure.

FIG. 8 is a longitudinal cross-sectional view illustrating a flow of air due to driving the cooking appliance according to the embodiment of the present disclosure, FIG. 9 is a view illustrating a flow of air due to driving a first fan and a second fan of a first cavity according to the embodiment of the present disclosure, FIG. 10 is a view illustrating a flow of air due to driving a third fan of a second cavity according to the embodiment of the present disclosure, and FIG. 11 is a view illustrating a flow of air due to driving the first cavity and the second cavity according to the embodiment of the present disclosure.

As illustrated in FIGS. 8 to 11, the cooking appliance 1 includes the cooling flow paths 50. The cavities 10 and 20 include inner cavities 10 and 20 and outer cavities 10 and 20. An insulating material may be provided between the inner cavities 10 and 20 and between the outer cavities 10 and 20. The cooking compartments 12 and 22 where food is cooked may be formed by the inner cavities 10 and 20.

The cooling flow paths 50 may be formed between the outer cavity 10 and 20 and the case 40. The cooling flow paths 50 may include the one or more fans 70. The fans 70 may include the first fan 71, the second fan 72, and a third fan 73. The first fan 71 and the second fan 72 may be disposed above the first cavity 10, and the third fan 73 may be disposed above the second cavity 20.

The first fan 71 and the second fan 72 are configured to form a flow of air that flows inside and outside the first cooking compartment 12. The third fan 73 is configured to form a flow of air that flows inside and outside the second cavity 20.

Movement of air that flows due to driving the cooking appliance 1 will be briefly described below.

Polluted air after cooking inside the first cavity 10 is suctioned by the first fan 71 via the first cavity hole 10*c* of the first cavity 10. The polluted air suctioned by the first fan 71 is discharged to the outside of the cooking appliance 1 via the first cooling flow path 51*a*. Here, the polluted air in the first cooling flow path 51*a* may be discharged to the outside of the cooking appliance 1 via an outlet 50*b* formed between a lower portion of the second cavity 20 and the bottom plate 44.

The second fan 72 disposed to be parallel to the first fan 71 may be installed above the first cavity 10. Air introduced into the case 40 by the second fan 72 may be introduced via an inlet 50*a* between the first door 11 of the first cavity 10 and the control panel 30.

Outside air introduced by the second fan 72 passes through the machine room 31 formed between the cavities 10 and 20 and the upper plate 41, cools the electronic components in the machine room 31, and flows to the second cooling flow path 52*a* behind the first cavity 10 and the second cavity 20. Air that flows via the second cooling flow path 52*a* may be discharged to the outside of the cooking appliance 1 via the outlet 50*b* formed between the lower portion of the second cavity 20 and the bottom plate 44.

The second heater installation member 120 may isolate the heater 200 from the first cooling flow path 51*a* and the second cooling flow path 52*a* so that introduction of air from the second cooling flow path 52*a* to the heater 200 is blocked, and thus efficiency of the heater 200 may be improved.

The third fan 73 may be installed above the second cavity 20. Polluted air after cooking inside the second cavity 20 is suctioned by the third fan 73 via a second cavity hole 20*c* of the second cavity 20. The polluted air suctioned via the third fan 73 is discharged to the outside of the cooking appliance 1 via the first cooling flow path 51*b*. Here, air may be discharged from the first cooling flow path 51*b* via the outlet 50*b* formed between the lower portion of the second cavity 20 and the bottom plate 44.

Air introduced into the case 40 by the third fan 73 may be introduced via an inlet between the second door 21 of the second cavity 20 and the first door 11. Outside air introduced by the third fan 73 passes through an upper portion of the second cavity 20 and flows to the second cooling flow path 52*b* by the third fan 73.

Air that flows via the second cooling flow path 52*b* may be discharged via the outlet 50*b* formed between the lower portion of the second cavity 20 and the bottom plate 44.

Here, the first cooling flow path 51*b* and the second cooling flow path 52*b* formed by the third fan 73 may be integrally formed without a separate partition.

Figure 12:
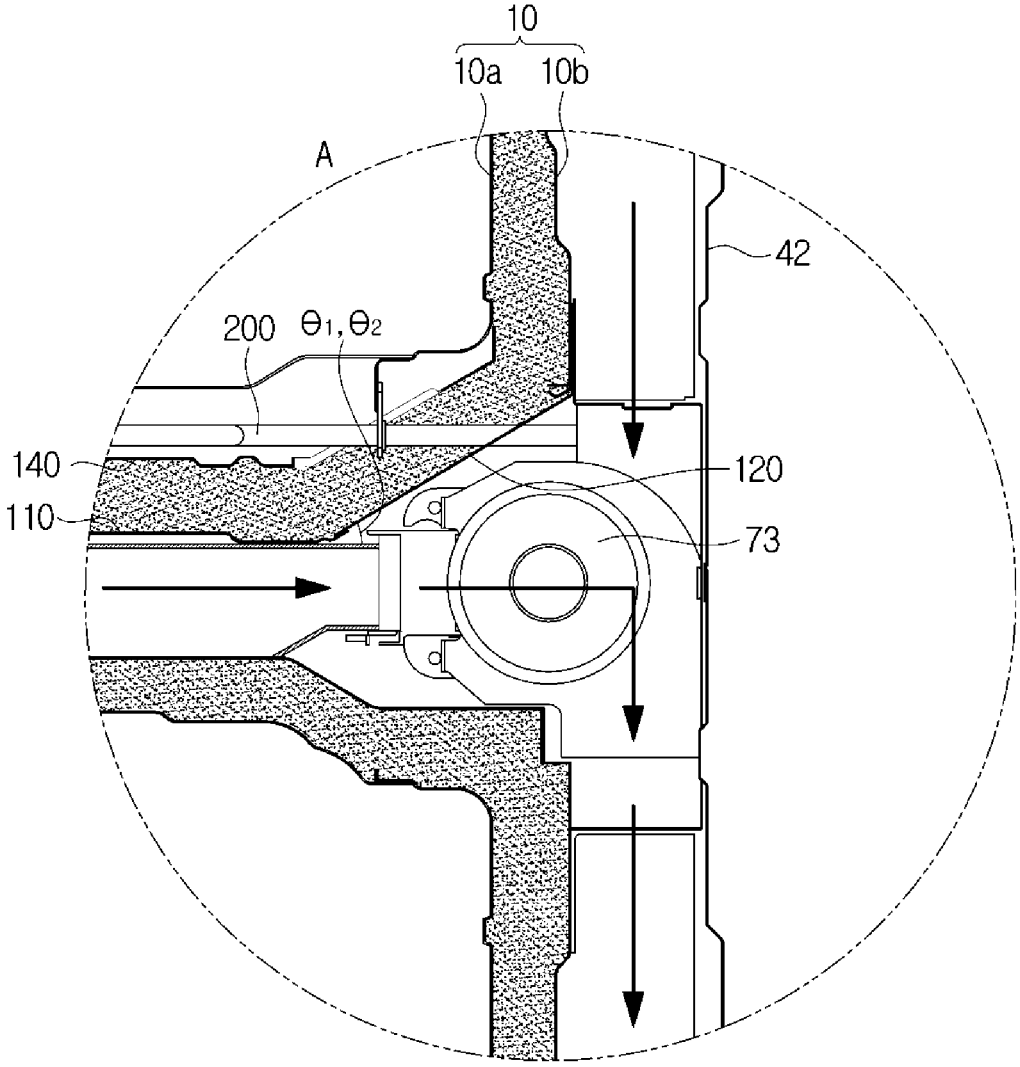
FIG. 12 is an enlarged view of a portion A in FIG. 8.
Figure 13:
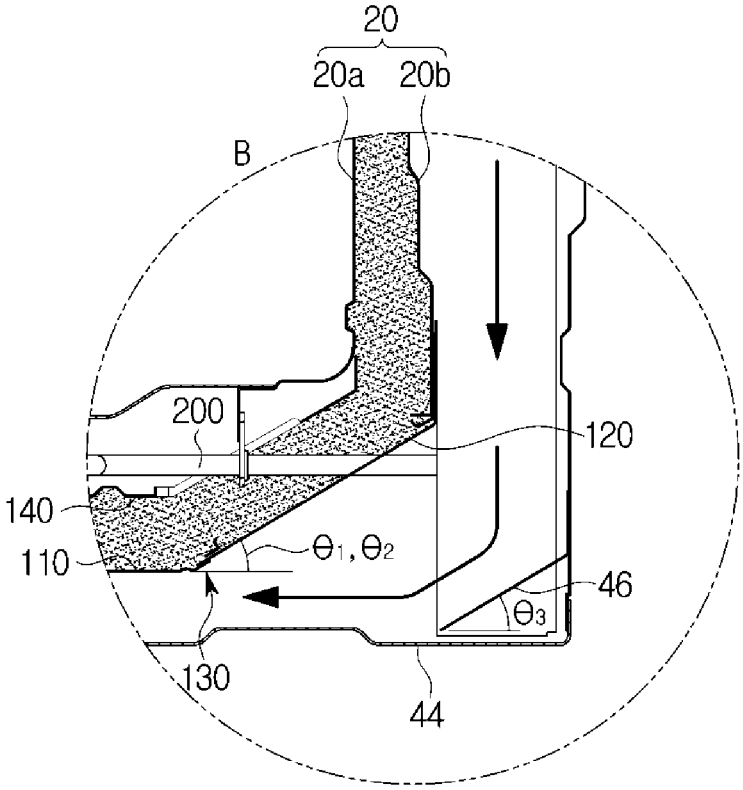
FIG. 13 is an enlarged view of a portion B in FIG. 8.

FIG. 12 is an enlarged view of a portion A in FIG. 8, and FIG. 13 is an enlarged view of a portion B in FIG. 8.

As illustrated in FIGS. 12 and 13, the second heater installation member 120 of the heater installation member 100 installed in the first cavity 10 is formed at the first angle θ1, thereby being able to form an installation space of the third fan 73.

The second heater installation member 120 may isolate the heater 200 from the cooling flow paths 50 formed between the first cavity 10 and the rear plate 42. The heater 200 is isolated from the cooling flow paths 50 by the second heater installation member 120, and thus heat loss from the heater 200 may be minimized, and efficiency of the heater 200 may be improved.

The second heater installation member 120 of the heater installation member 100 installed in the second cavity 20 is formed at the first angle θ1, thereby being able to secure a flow path capacity of the a flow paths 50 and facilitating a flow of air that flows inside the cooling flow paths 50.

The case 40 may further include a flow path guide 46 provided on the cooling flow paths 50. The flow path guide 46 may be formed to improve a vortex phenomenon in the cooling flow paths 50. The flow path guide 46 may be formed with an inclined plate having a streamlined shape. The flow path guide 46 may be formed at a third angle θ3 behind the second heater installation member 120 installed in the second cavity 20. The third angle θ3 of the flow path guide 46 may be identical to the second angle θ2 of the second heater installation member 120. The flow path guide 46 may be formed with a slope corresponding to that of the rear portion of the second heater installation member 120. The flow path guide 46 may guide a flow of air that vertically moves upward via the first cooling flow path 51*a* and the second cooling flow path 52*a* and guide air so that air is discharged via the outlet 50*b* provided at a front portion of the cooking appliance 1.

Although an example in which the heater installation member are installed in the built-in cooking appliance including the first cavity and the second cavity disposed by being stacked is illustrated in the embodiment of the present disclosure, the idea of the present disclosure is not limited thereto. For example, the heater installation member may be applied to a cooking appliance 1A installed in a general kitchen. The heater installation member may also be installed in a partition applied to the cooking appliance.

Figure 14:
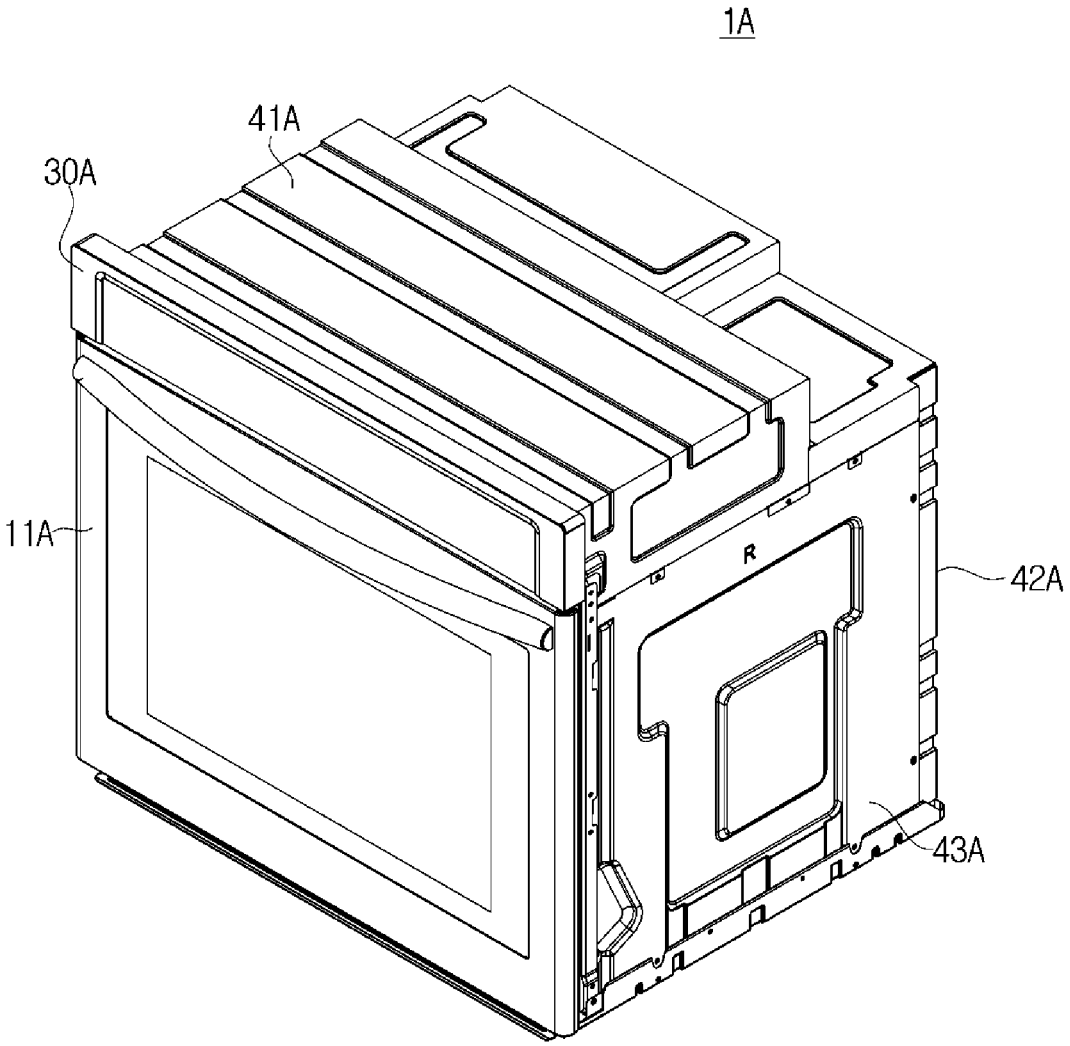
FIG. 14 is a perspective view illustrating a cooking appliance according to another embodiment of the present disclosure.
Figure 15:
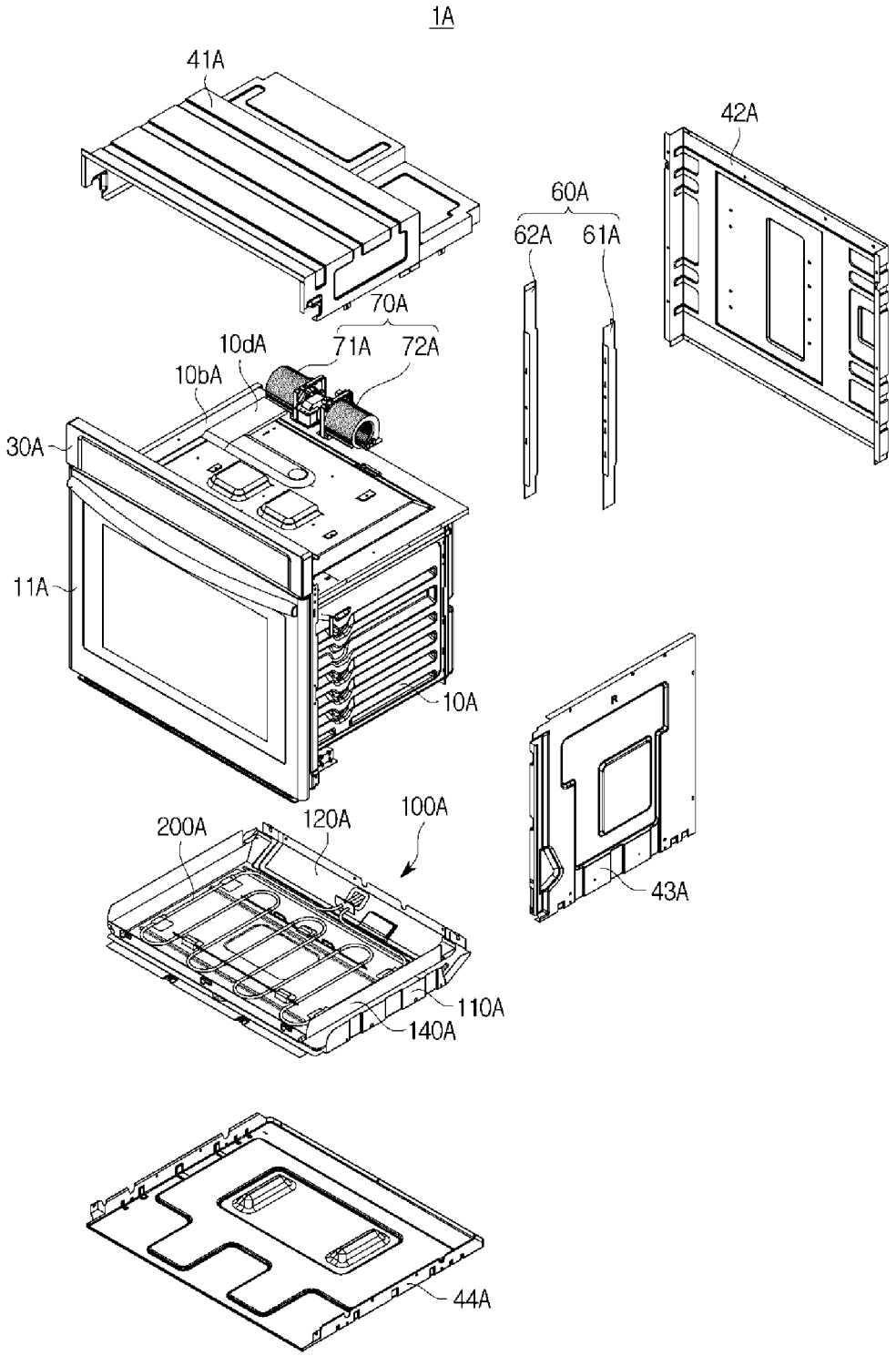
FIG. 15 is an exploded perspective view illustrating heater installation member installed in the cooking appliance according to another embodiment of the present disclosure.

FIG. 14 is a perspective view illustrating a cooking appliance according to another embodiment of the present disclosure, and FIG. 15 is an exploded perspective view illustrating heater installation member installed in the cooking appliance according to another embodiment of the present disclosure. Refer to FIGS. 1 to 13 for elements which are not marked with reference symbols.

As illustrated in FIGS. 14 and 15, heater installation member 100A for installing a heater 200A in the cooking appliance 1A may be provided.

The cooking appliance 1A includes a cavity 10A, a case 40A provided outside the cavity 10A, the heater 200A installed below the cavity 10A, and the heater installation member 100A provided so that the heater 200A is installed to be detachable from the cavity 10A.

The heater installation member 100A may include a first heater installation member 110A and a second heater installation member 120A attachable to or detachable from the first heater installation member 110A. The heater installation member 100A may be installed below the cavity 10 by a heater cover 140A. The heater cover 140A is formed with an insulating material and is coupled to a lower portion of the cavity 10A o that the heater 200A may be supported.

Here, the heater cover 140A may be formed with a rear portion that is open to allow the heater 200A to be movable in a front-rear direction of the heater cover 140A.

The second heater installation member 120A may be coupled to a rear portion of the first heater installation member 110A at the second angle θ2 and may be detachable therefrom.

Because a specific structure and operations of the heater installation member 100A are easily predictable from the above descriptions, overlapping descriptions will be omitted.

Figure 16:
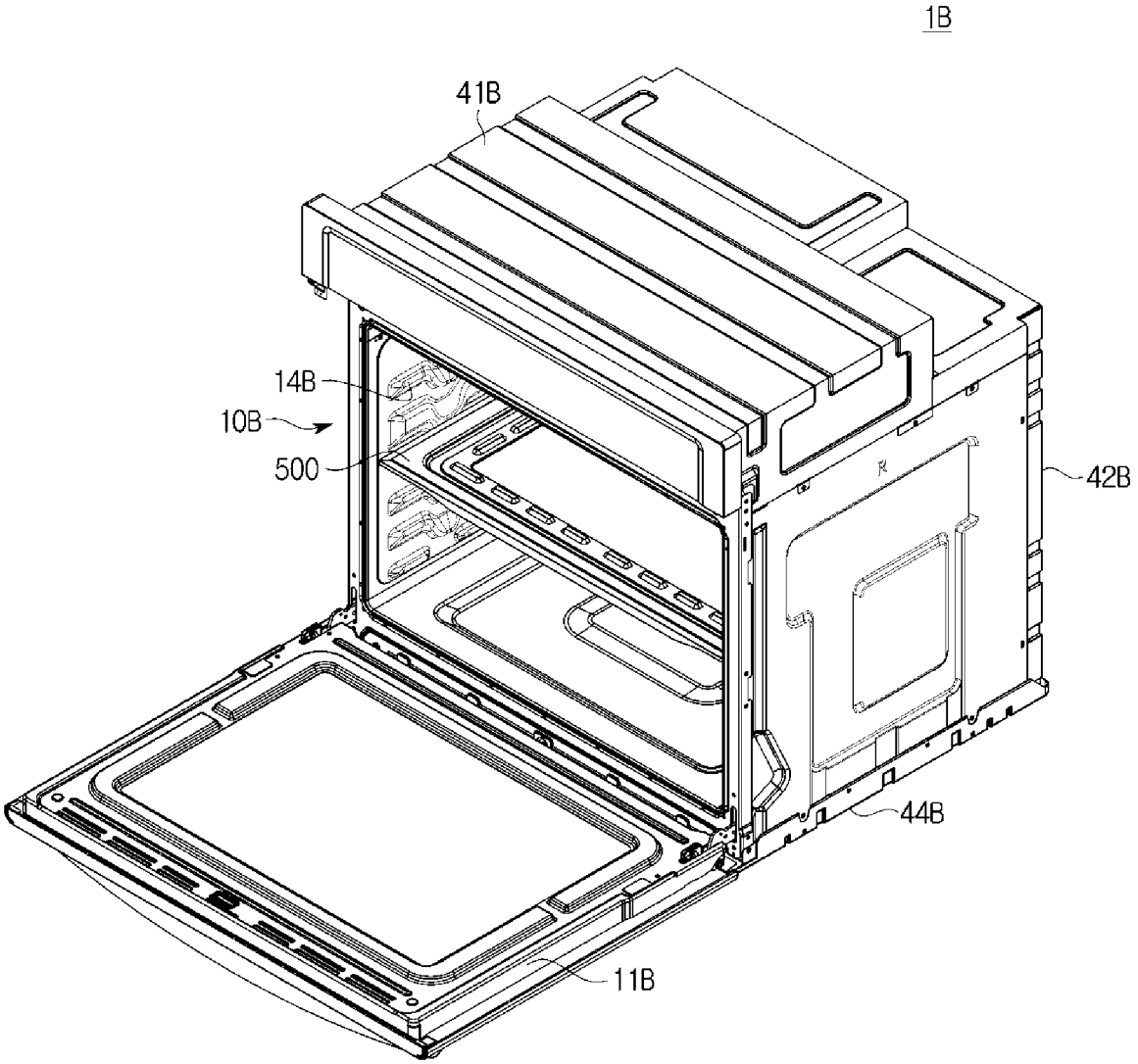
FIG. 16 is a perspective view illustrating a partition of a cooking appliance according to still another embodiment of the present disclosure.
Figure 17:
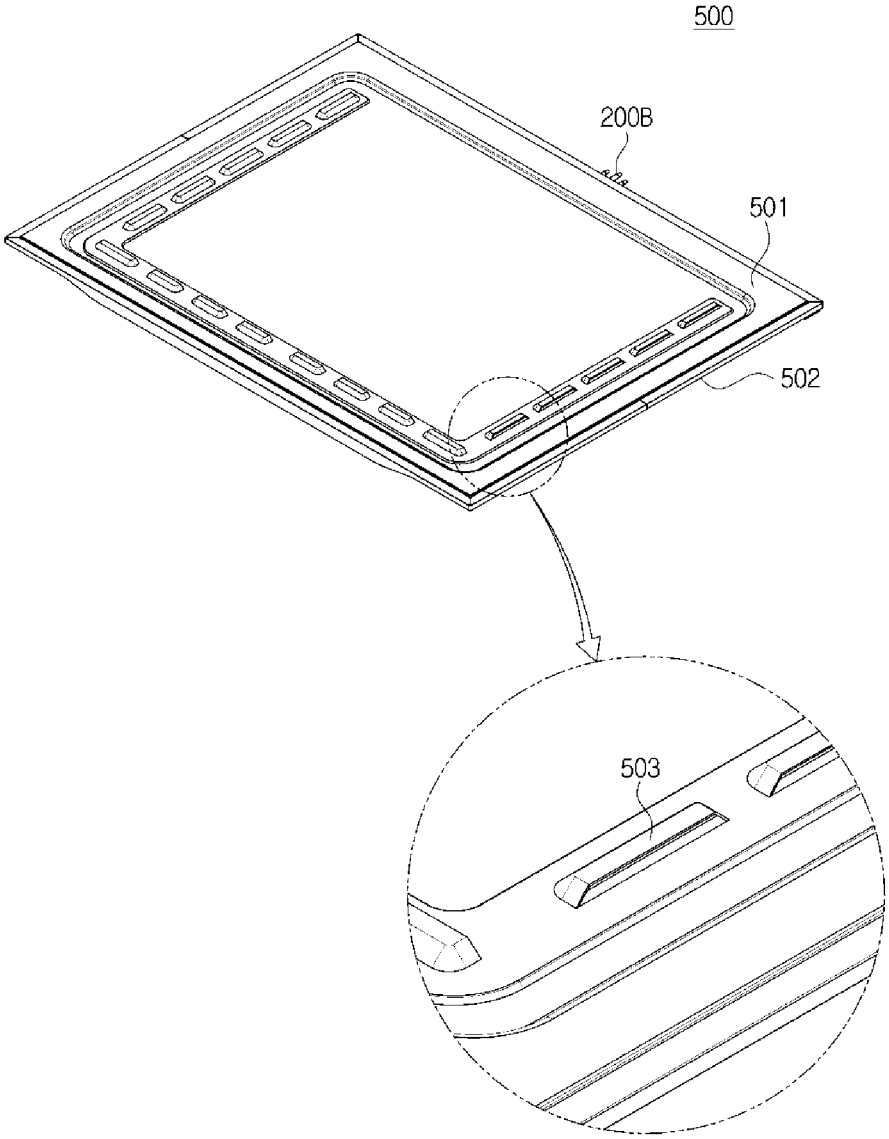
FIG. 17 is a view illustrating the partition according to yet another embodiment of the present disclosure.
Figure 18:
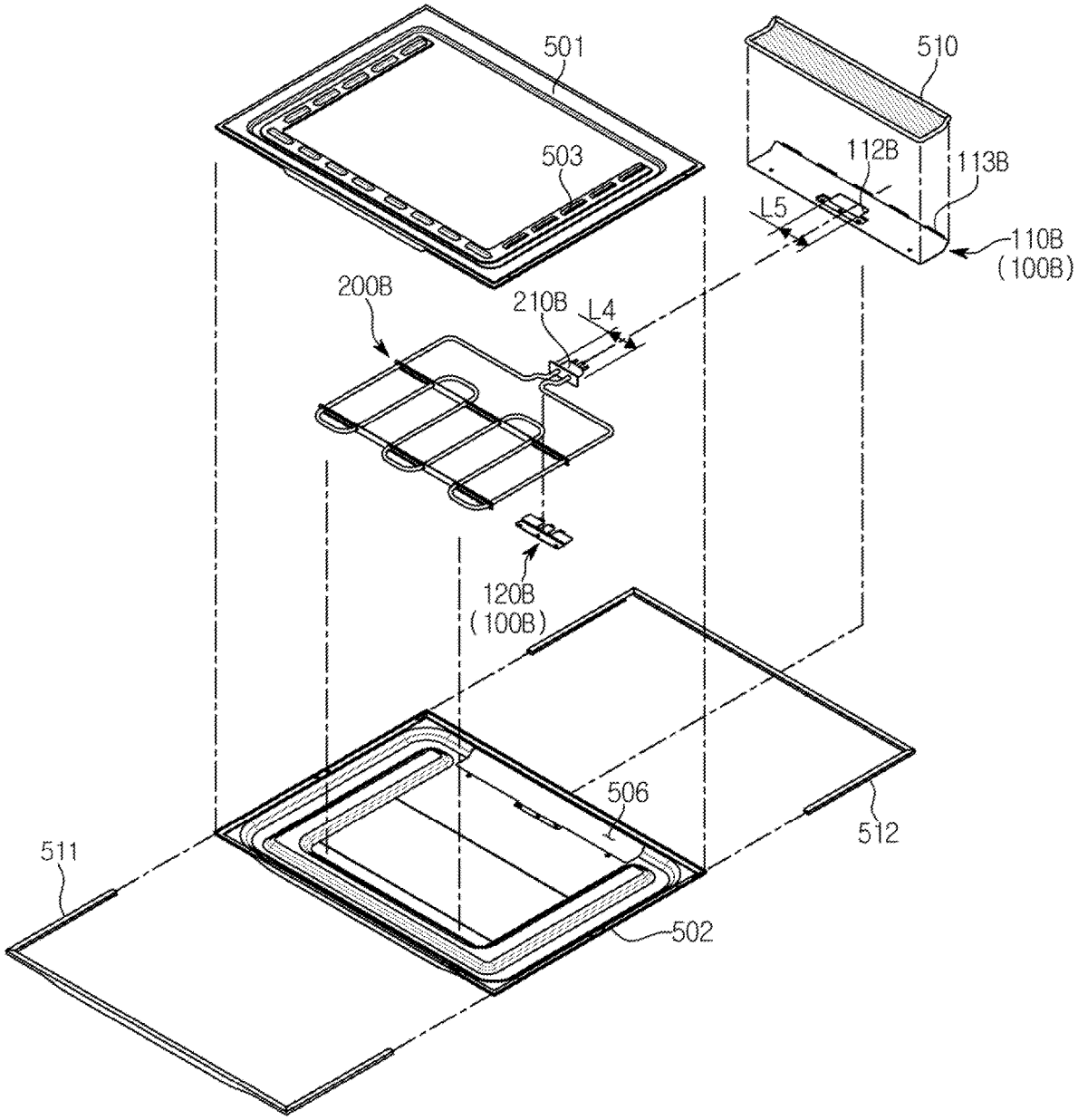
FIG. 18 is an exploded perspective view illustrating a partition in which heater installation member are installed according to yet another embodiment of the present disclosure.

FIG. 16 is a perspective view illustrating a partition of a cooking appliance according to still another embodiment of the present disclosure, FIG. 17 is a view illustrating a partition according to yet another embodiment of the present disclosure, and FIG. 18 is an exploded perspective view illustrating a partition in which heater installation member are installed according to yet another embodiment of the present disclosure.

As illustrated in FIGS. 16 to 18, a cooking compartment formed in a cavity 10B of a cooking appliance 1B may be divided by a partition 500.

Different foods may be cooked in upper and lower portions of the cooking compartment divided by the partition 500.

The partition 500 may be attachable to or detachable from by sliding in a front-rear direction along one or more rails 14B formed at inner peripheral surfaces at both sides of the cavity 10B.

The partition 500 may include an upper partition 501 forming an upper surface, a lower partition 502 forming a lower surface, a heater 200B disposed between the upper partition 501 and the lower partition 502, and the heater installation member 100B provided so that the heater 200B is attachable to or detachable from the heater installation member 100B.

The upper partition 501 and the lower partition 502 may be formed with plate materials and coupled to each other to form a space for installing the heater 200B therebetween. The upper partition 501 and the lower partition 502 may have sizes and shapes corresponding to each other. The upper partition 501 and the lower partition 502 may be coupled to each other by fixing brackets 511 and 512. The fixing brackets 511 and 512 may include a first fixing bracket 511 configured to couple front portions of the upper partition 501 and the lower partition 502 and a second fixing bracket 512 configured to couple rear portions of the upper partition 501 and the lower partition 502.

One or more holes 503 formed to be open so that heat generated from the heater 200B is transmitted to an outside of the partition 500 may be formed at an edge of the upper partition 501. The holes 503 may be disposed to be spaced a predetermined distance apart from each other. Preferably, the holes 503 are disposed at edges of four sides of the upper partition 501.

A heater installation member installation hole 506 for installing the heater installation member 100B is formed at a rear portion of the lower partition 502. The heater installation member installation hole 506 is formed by at least a portion of the lower partition 502 being open. The heater installation member installation hole 506 is formed longer than a transverse length of the heater 200B so that the heater 200B may be inserted into and withdrawn from the heater installation member installation hole 506.

The heater installation member 100B may include a first heater installation member 110B and a second heater installation member 120B attachable to or detachable to the first heater installation member 110B.

The first heater installation member 110B is formed in a shape corresponding to that of the heater installation member installation hole 506 of the lower partition 502. A gasket 510 for insulating the heater 200B may be disposed between the heater installation member installation hole 506 and the first heater installation member 110B.

A second heater installation member installation hole 112B, which is open, may be formed in at least a portion of the first heater installation member 110B. The second heater installation member 120B is provided to be coupled to the first heater installation member 110B.

The second heater installation member installation hole 112B of the first heater installation member 110B is formed so that a heater bracket 210B of the heater 200B may be inserted thereinto and pass therethrough. Here, a fifth length L5 of the second heater installation member installation hole 112B is preferably formed to be larger than a fourth length L4 of the heater bracket 210B.

Consequently, the heater 200B is detachable from the lower partition 502 by the first heater installation member 110B so that after-sales service of the heater 200B is facilitated, and the heater 200B and the heater bracket 210B installed to pass through the second heater installation member installation hole 112B of the first heater installation member 110B are insulated by the second heater installation member 120B so that heat loss from the heater 200B is prevented.

As is apparent from the above description, in accordance with one embodiment of the present disclosure, due to an improved heater installation structure, replacement and after-sales service of a heater may be facilitated.

Further, a service cost may be reduced by enabling replacement of a heater.

Furthermore, efficiency of a heater may be improved by being able to separate a cooling flow path and the heater due to an improved heater installation structure.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cooking appliance comprising:

a main body having a cavity formed therein;

a heater configured to generate heat to heat an object to be placed in the cavity; and a partition to be inserted into or withdrawn from the main body, and configured to partition the cavity when the partition is inserted into the main body, the partition including:

an upper partition;

a lower partition coupled with the upper partition, the lower partition including an opening formed at a rear portion of the lower partition that is longer than a length of the heater, the heater installed between the upper partition and the lower partition so that the heater is attachable to or detachable from the partition through the opening;

a first heater installation member couplable to the opening of the lower partition to cover or uncover the opening of the lower partition, the first heater installation member including a second heater installation member installation hole formed to allow a heater bracket of the heater to be inserted therein and pass therethrough; and a second heater installation member attachable to or detachable from the first heater installation member to cover the heater bracket inserted into the second heater installation member installation hole.

2. The cooking appliance of claim 1, further comprising a gasket couplable to the first heater installation member installation hole for thermal insulation.

3. The cooking appliance of claim 1, wherein the upper partition further includes a plurality of holes formed to allow the generated heat of the heater to be transferred to the cavity.

4. The cooking appliance of claim 3, wherein the plurality of holes are spaced apart from each other at edges of four sides of the upper partition.

5. The cooking appliance of claim 1, wherein the partition further includes a fixing bracket provided to couple the upper partition to the lower partition.

6. The cooking appliance of claim 1, further comprising a plurality of fixing brackets to couple the upper partition with the lower partition, and including a first fixing bracket configured to couple a front portion of the upper partition with a front portion of the lower partition, and a second fixing bracket configured to couple a rear portion of the upper partition with a rear portion of the lower partition.

7. A cooking appliance comprising:

a main body having a cavity formed therein;

a heater configured to generate heat to heat an object to be placed in the cavity, and arranged in the cavity; and a partition to be inserted into or withdrawn from the main body, and configured to partition the cavity when the partition is inserted into the main body, the partition including:

an upper partition;

a lower partition coupled to the upper partition to form a space thereinbetween, the lower partition including an opening formed at a rear portion of the lower partition that is longer than a length of the heater, the heater installed in the space so that the heater is attachable to or detachable from the partition through the opening while the upper partition and the lower partition are coupled;

a first heater installation member couplable to the rear portion of the lower partition to cover or uncover the opening of the lower partition, the first heater installation member including a first hole formed therein and through which a part of the heater passes for an electrical connection; and a second heater installation member couplable to the first heater installation member, the second heater installation member including a second hole formed therein to partially cover the opening of the lower partition while allowing the part of heater to pass through the second hole.

8. The cooking appliance of claim 7, further comprising a gasket installed between the first hole and the first heater installation member for thermal insulation.

9. The cooking appliance of claim 7, wherein the upper partition further includes a plurality of holes formed to allow the generated heat of the heater to be transferred to the cavity.

10. The cooking appliance of claim 9, wherein the plurality of holes are spaced apart from each other at edges of four sides of the upper partition.

11. The cooking appliance of claim 7, wherein the partition further includes a fixing bracket provided to couple the upper partition to the lower partition.

12. The cooking appliance of claim 7, further comprising a plurality of fixing brackets to couple the upper partition with the lower partition, and including a first fixing bracket configured to couple a front portion of the upper partition with a front portion of the lower partition, and a second fixing bracket configured to couple a rear portion of the upper partition with a rear portion of the lower partition.

* * * * *